United States Patent [19]

Slovitt et al.

[11] 4,040,127

[45] Aug. 9, 1977

[54] LIP PROTECTOR

[76] Inventors: Simon Slovitt; Miriam Slovitt, both of 5901 NW. 61st Ave., Tamarac, Fla. 33319

[21] Appl. No.: 689,357

[22] Filed: May 24, 1976

[51] Int. Cl.[2] ..... A42B 1/00

[52] U.S. Cl. ..... 2/174; 2/9

[58] Field of Search ..... 2/2, 46, 174, 9

[56] References Cited

U.S. PATENT DOCUMENTS

| | | | |
|---|---|---|---|
| 1,943,751 | 1/1934 | Van Dunker | 2/174 |
| 1,949,013 | 2/1934 | Gilchrist | 2/174 |
| 2,023,900 | 12/1935 | Rally | 2/174 |
| 2,088,076 | 7/1937 | Winslow | 2/174 X |
| 2,434,078 | 1/1948 | Malerman | 2/9 |
| 2,535,084 | 12/1950 | Meunier | 2/174 |
| 2,640,991 | 6/1953 | Ernst | 2/174 |

FOREIGN PATENT DOCUMENTS

| | | | |
|---|---|---|---|
| 70,629 | 8/1944 | Norway | 2/174 |

*Primary Examiner*—Alfred R. Guest
*Attorney, Agent, or Firm*—Allen D. Brufsky

[57] ABSTRACT

A device to cover the lips of the user to protect the lips from the effect of prolonged sun and wind including a one-piece flexible blank folded into a substantially V-shaped configuration. The legs of the V are inserted in the mouth of the user and the flanges cover the lips. An oval opening is provided in the legs to enable the mouth of the user to function normally for eating and talking.

9 Claims, 6 Drawing Figures

LIP PROTECTOR

BACKGROUND OF THE INVENTION

This invention relates to a device for protecting the lips of the user from the elements, such as the sun or wind.

Excessive exposure of a person's lips to the sun or wind will cause the lips to chap, crack, or blister. This invention provides a device for protecting the lips of the user, without impairing the ability of the user to speak, eat, smoke or perform any other normal function associated with the mouth.

SUMMARY OF THE INVENTION

In accordance with the invention, a blank of sun-screening material is stamped from a sheet of such specially treated material. The blank generally conforms to the shape of the lips and includes a central oval opening and three parallel score lines. The blank is folded along the score lines to form a substantially V-shaped configuration including a pair of legs, each of which includes one-half of the oval opening, and a pair of lateral flanges. The legs of the folded V-shaped blank are inserted into the mouth of the user and the flanges extend upwardly and downwardly over the lips to form a protective cover. Normal functions of the mouth are carried out through the oval opening.

In an alternate embodiment, slits are provided along opposite edges of the oval opening, wherein tabs are formed by bending the material which is inserted between the teeth of the user so as to lock the device in the mouth and prevent it from accidentally falling out while talking.

BRIEF DESCRIPTION OF THE DRAWING

Further objects and advantages of the invention will become apparent from the following description and claims, and from the accompanying drawing, wherein:

DETAILED DESCRIPTION OF THE PREFERRED EMBODIMENTS

Figure 1:
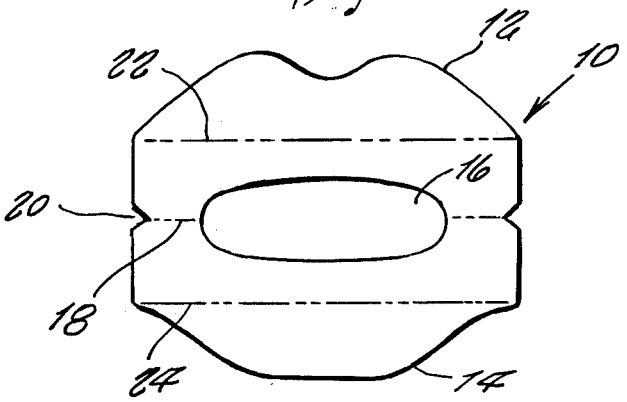
FIG. 1 is a front view in elevation of the blank for forming the lip protector of the present invention.
Figure 2:
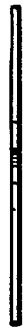
FIG. 2 is a side view in elevation of the lip protector blank of FIG. 1 as seen from the right-hand side of FIG. 1.

Referring now in detail to the drawing, wherein like numerals indicate like elements throughout the several views, a blank 10 of specially treated sun-screening material is stamped from a sheet of such material. The blank 10 has an upper and lower edge 12 and 14, respectively, generally conforming to the shape of a person's lips.

Blank 10 includes a central oval opening 16 bisected by a score line 18, whose ends are cut by V-shaped slots 20 to increase the flexibility of the material when folding it about score line 18. A second and third score line 22 and 24 are provided in blank 10 above and below opening 16, respectively, and parallel to score line 18.

Figure 3:
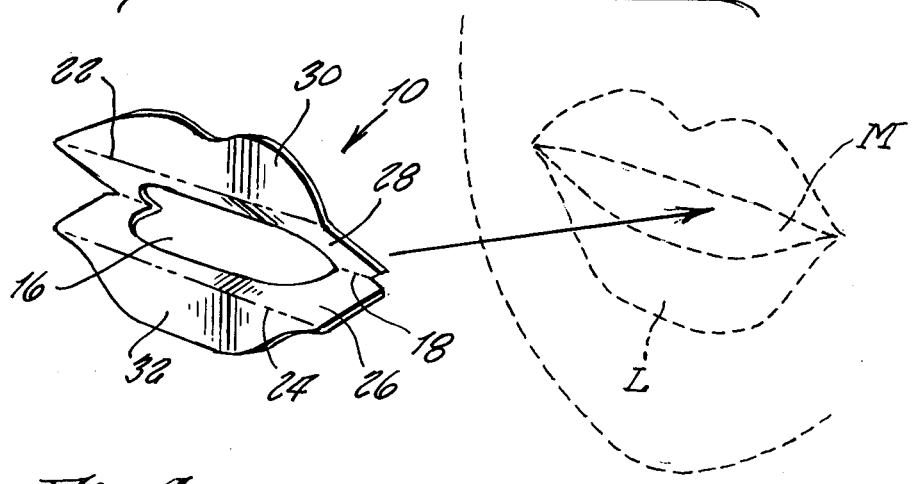
FIG. 3 is a perspective view of the folded lip protector blank of FIG. 1 adapted to be inserted for use in the mouth of a user.
Figure 4:
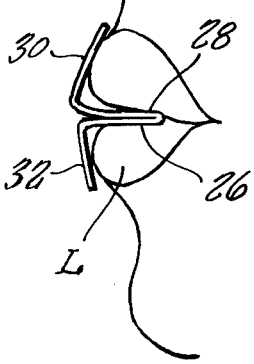
FIG. 4 is a side view in elevation of the lip protector of FIG. 3 inserted in the mouth of a user.

As shown in FIG. 3, when in use, blank 10 is folded about score lines 18, 22, and 24 to form a substantially V-shaped configuration including a pair of legs 26, 28, each of which includes one-half of opening 16, and a pair of lateral flanges 30 and 32. The legs 26, 28 of the folded blank 10 are inserted into the mouth M of the user and the flanges 30 and 32 extend upwardly and downwardly, respectively, over the lip L to form a protective cover. Normal functions of the mouth M, such as eating and talking, are carried out through the oval opening 16.

Figure 5:
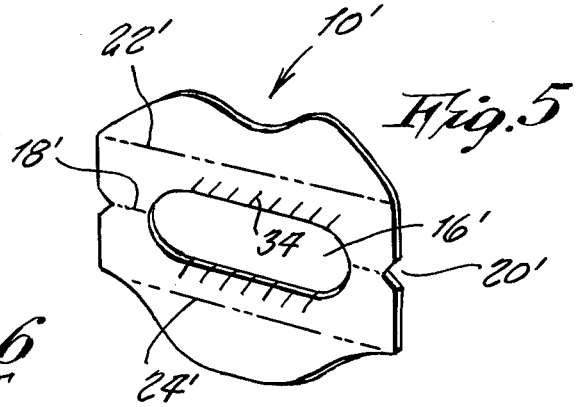
FIG. 5 is a perspective view of an alternate form of lip protector blank within the scope of the present invention.
Figure 6:
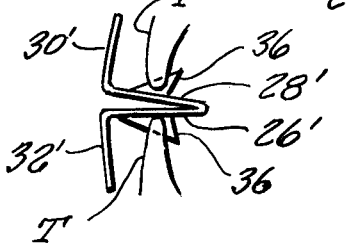
FIG. 6 is a side view in elevation of the folded blank of FIG. 5 inserted between the teeth of a user.

In the alternate embodiment illustrated in FIGS. 5 and 6, elements corresponding to blank 10 are indicated by primed numerals. The folding and use of blank 10' is identical to blank 10, except that slits 34 are provided along the opposite edges of opening 16'. The material between slits 34 can be twisted to form tabs 36 which are inserted between the teeth T of the user to lock the device in the mouth and prevent it from accidentally falling out while talking.

We claim:

1. A lip protector comprising a one-piece member of flexible material folded into a substantially V-shaped configuration including a pair of legs adapted to be inserted in the mouth of the user, said legs including an opening therethrough, a plurality of tabs bent from the material about said opening, said tabs adapted to be inserted between adjacent lateral surfaces of the teeth of each individual jaw of the user; and a laterally extending flange connected to each leg adapted to cover the lips of the user when the legs are inserted in the mouth.

2. A lip protector in accordance with claim 1 wherein said flanges extend in opposite directions.

3. A lip protector in accordance with claim 1 wherein a portion of said opening is disposed in each of said legs.

4. A lip protector in accordance with claim 1 wherein said flanges conform in shape to the lips of the user.

5. The blank for forming the lip protector of claim 1.

6. The blank for forming the lip protector of claim 3.

7. A lip protector in accordance with claim 3 wherein said opening is oval in shape.

8. A lip protector in accordance with claim 1 including a score line at the juncture of each of said legs with said flanges.

9. A lip protector in accordance with claim 8 wherein said opening in said legs is disposed between said score lines, a third score line bisecting said opening at the juncture of said legs parallel to the said score lines at the juncture of each of said legs with said flanges.

* * * * *